US006991292B2

(12) United States Patent
Kasten

(10) Patent No.: US 6,991,292 B2
(45) Date of Patent: Jan. 31, 2006

(54) DYNAMIC SEAT SUPPORT FOR A WHEELCHAIR

(75) Inventor: Jon-Michael Kasten, Kirkland, WA (US)

(73) Assignee: Adaptive Engineering Lab, Inc., Mill Creek, WA (US)

( * ) Notice: Subject to any disclaimer, the term of this patent is extended or adjusted under 35 U.S.C. 154(b) by 0 days.

(21) Appl. No.: 10/854,940

(22) Filed: May 27, 2004

(65) Prior Publication Data

US 2005/0264073 A1 Dec. 1, 2005

(51) Int. Cl.
*A47C 3/02* (2006.01)

(52) U.S. Cl. ..... 297/326; 297/313; 297/338; 297/DIG. 4

(58) Field of Classification Search ..... 297/326, 297/328, 312, 302.4, 302.1, 195.1, 208, 209, 297/325, 313, DIG. 4, 344.1; 248/562, 580; 267/166, 177; 280/250.1, 304.1
See application file for complete search history.

(56) References Cited

U.S. PATENT DOCUMENTS 1,167,597 A * 1/1916 Riehm ..... 297/188.1
1,836,353 A * 12/1931 Withrow ..... 248/574
2,329,673 A * 9/1943 Wood ..... 297/303.5
3,455,600 A * 7/1969 Secor et al. ..... 297/45
3,917,312 A * 11/1975 Rodaway ..... 280/250.1
4,544,200 A * 10/1985 Dunn et al. ..... 297/265.1
4,641,848 A * 2/1987 Ayers ..... 280/250.1
5,004,259 A * 4/1991 Ayers et al. ..... 280/304.1
5,738,409 A * 4/1998 Bursik ..... 297/265.1
5,904,398 A * 5/1999 Farricielli ..... 297/313
6,447,064 B1 * 9/2002 Mundy et al. ..... 297/313
6,547,206 B1 * 4/2003 Dickie ..... 248/575
2005/0046255 A1 * 3/2005 Bressler et al. ..... 297/326

FOREIGN PATENT DOCUMENTS

DE 3327606 A1 * 2/1985
EP 67035 A1 * 12/1982
EP 470544 A1 * 2/1992
EP 547005 A1 * 6/1993

* cited by examiner

*Primary Examiner*—Peter M. Cuomo
*Assistant Examiner*—Stephen D'Adamo
(74) *Attorney, Agent, or Firm*—George E. Haas; Quarles & Brady LLP

(57) ABSTRACT

A seat is pivotally connected to a frame of a wheelchair and is connected by one or more resilient supports. Each support includes a housing attached to either the seat or the frame and a bracket arrangement attached to the other of those wheelchair components. A spring biases the bracket arrangement with respect to the housing and an adjuster enables the force of the spring to be varied to alter resiliency of the support.

16 Claims, 2 Drawing Sheets

DYNAMIC SEAT SUPPORT FOR A WHEELCHAIR

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to wheelchairs, and more particularly to the seat and seat supports of the wheelchair.

2. Description of the Related Art

Wheelchairs are commonly used by people who are unable to walk. The typical wheelchair has tubular metal frame with large rear wheels at each side and smaller front wheels which typically swivel. In its simplest form, the seat of the wheelchair comprises a sheet of material hung between two horizontal arms of the frame and a similar vertical sheet of material strung between two vertical posts at the rear of the wheelchair. Such sheets of material are flexible thereby conforming to the contour of the user's body.

This simple seat arrangement can aggravate certain medical conditions of some wheelchair users, especially those with spinal abnormalities or injuries. In any case, this basic seat is not very comfortable for users who sit in the wheelchair for prolonged periods of time. As a consequence, padded seats with foam cushions for the seat bottom and back have been developed. The bottom and back cushions are contoured to the general shape of the human anatomy for improved comfort. The elements of this seat are rigidly secured to the frame of the wheelchair.

Although the more elaborate seats offer increased comfort because of the foam cushions, their secure attachment to the wheelchair frame provides relatively rigid support for the user. Therefore, there still exists a need for a more comfortable wheelchair seating system, especially one that can be adjusted to the preferences of each user.

SUMMARY OF THE INVENTION

A seat assembly for a wheelchair comprises a seat that preferably is pivotally connected to a frame of the wheelchair. One or more resilient supports are disposed between the frame and the seat so as to allow relative motion there between.

Each support includes a housing attached to either the seat or the frame and a bracket arrangement that is attached to the other of the seat and the frame. A spring biases the bracket arrangement with respect to the housing. An adjuster is provided to vary the force that the spring exerts between the first bracket arrangement and the first housing to thereby adjust resiliency of the support.

In a preferred embodiment of the seat assembly the spring is within the housing which has a pair of longitudinal apertures on opposite sides. The bracket arrangement extends through both of the longitudinal apertures and engages an end of the spring. The adjuster has a threaded shaft that extends into a threaded aperture in either the housing or the bracket arrangement, wherein screwing the threaded shaft into and out of the threaded aperture varies the force exerted by the spring.

DETAILED DESCRIPTION OF THE INVENTION

Figure 1:
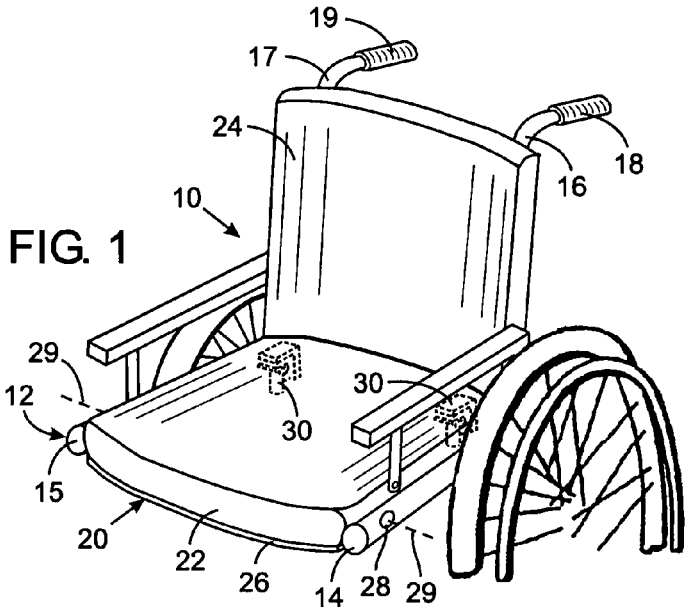
FIG. 1 is an isometric frontal view of a wheelchair with a seat support system according to the present invention.

With initial reference to FIG. 1, a wheelchair 10 has a tubular metal frame 12 that includes two horizontal members 14 and 15 and a pair of vertical posts 16 and 17 which bend into handles 18 and 19. A seat 20 of the wheelchair comprises a seat bottom 22 and a seat back 24 in a substantially orthogonal orientation to each other. Both the seat bottom and back 22 and 24 comprise cushions that are contoured to conform to the curvature of a wheelchair user's buttocks and back, respectively. These cushions are supported on a curved. plastic shell 26, however other seat constructions may be used. For example, the seat bottom 22 and back 24 may be mounted independently to the wheelchair frame 12, in which case different supports described herein can be employed to separately attach the seat bottom and back. Therefore, as used herein the term "seat structure" refers to seat bottom or the seat back individually, as well as a combination of the seat bottom and back.

The seat 20 is attached to the frame 12 by a resilient support system that provides a degree of shock absorption as the wheelchair rolls along. The front section of the seat 20 is pivotally connected to each of the horizontal members 14 and 15 of the frame 12 by pins 28 with only one pin being visible in FIG. 1. The coupling by the pins 28 allows the seat 20 to pivot about a transverse horizontal axis 29 with respect to the frame 12.

Figure 2:
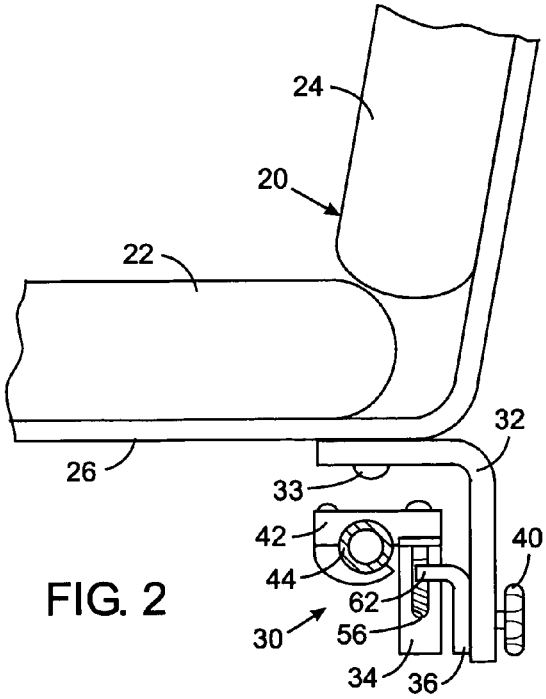
FIG. 2 is a side view showing an adjustable support that connects the rear of the seat to the wheelchair frame.
Figure 3:
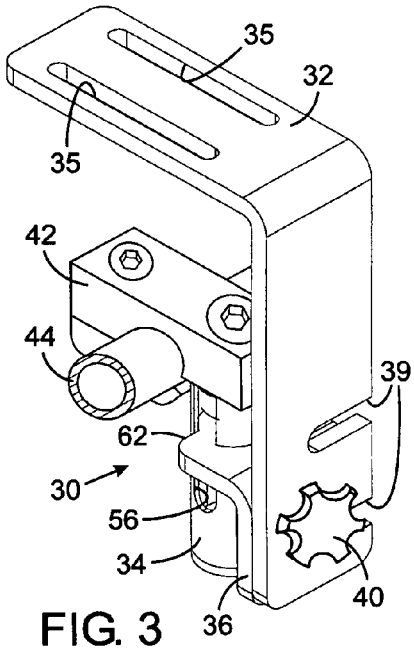
FIG. 3 isometric view of the adjustable support.

With reference to FIGS. 2 and 3, the rear of the seat 20 is coupled to the horizontal frame members 14 and 15 by separate supports 30. Each support 30 includes an L-shaped first bracket 32 having one leg attached to the bottom section of the seat shell 26 by two machine screws 33 that extend through slots 35 in the leg. With additional reference to FIG. 4, a spring cartridge 34 has an L-shaped second bracket 36 from which a bolt 38 projects through one of a plurality of open slots 39 in the other leg of the first bracket 32. A knob 40 is threaded onto the bolt 38 to secure the first and second brackets 32 and 32 together in an adjustable manner. A third bracket 42 is attached to one end of the spring cartridge 34 and clamps around a horizontal transverse member 44 of the wheelchair frame 12.

Figure 4:
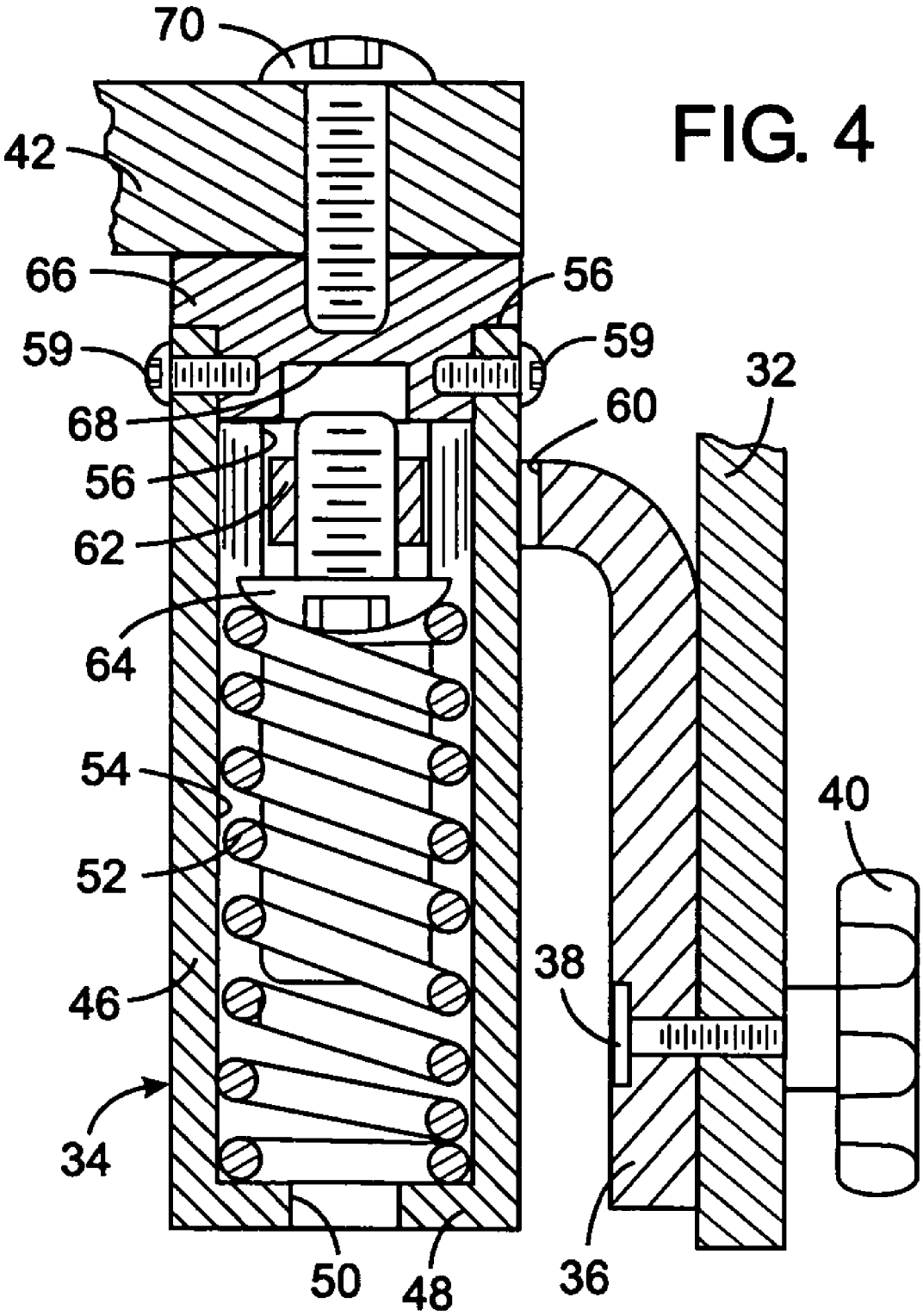
FIG. 4 is a cross section view through a portion of the adjustable support.

The details of the spring cartridge 34 are shown in the cross-sectional diagram in FIG. 4. The spring cartridge 34 has a tubular housing 46 with a closed end 48 that has a centrally located aperture 50. A coil spring 52 is located within the bore 54 of the housing 46, abutting the closed end 48. A pair of slots 56 extend longitudinally through the wall on opposite sides of the housing with the slots opening through the open end 58, (see also FIGS. 2 and 3).

The second bracket 36 has an aperture 60 in one leg, allowing the end 62 of that leg to be slidably received within the longitudinal slots 56. That end 62 of the second bracket 36 has a threaded aperture within which an adjusting screw 64 is received. The head of the adjusting screw 64 is larger than the inner diameter of the coil spring 52 so that the screw head engages the exposed end of that spring.

The open end 58 of the housing 46 is closed by a cap 66 that is held in place by a pair of machine screws 59 that extend through apertures in the wall of the housing. The cap 66 has an internal recess 68 for receiving the threaded end of the adjusting screw 64. The flat external surface of the cap 66 has a threaded aperture that receives a machine screw 70 which holds the third bracket 42 on the end of the spring cartridge 34.

When the seat 20 of the wheelchair 10 is empty, the spring 52 extends fully which pushes the adjusting screw 64 and the second bracket 36 upward within the cartridge housing 46, until the internal end 62 of that bracket abuts the inner surface of the cap 66. When a person sits in the seat 20 of the wheelchair 10, the added weight on the seat is transferred through the first and second L-shaped brackets 32 and 36 to the coil spring 52 within the housing 46. This weight exerts a downward force which compresses the spring 52, causing the seat to lower slightly with respect to the frame 12 of the wheelchair. This downward motion continues until the spring force equals the downward force from the seat.

By inserting an allen wrench through the aperture 50 in the closed end 48 of the housing 46, the adjusting screw 64 can be moved into and out of the aperture in the internal end 62 of the second bracket 36. This adjustment varies the preload force of the coil spring 52 and thus the amount of travel which occurs when a person sits on the wheelchair seat 20. By adjusting the spring force in this manner, the amount of bounce, or resiliency, of the wheelchair seat 20 with respect to the frame 12 can be varied as desired to accommodate the preference of the user.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. A seat assembly for a wheelchair having a frame, the seat assembly comprising:

a seat structure adjacent the frame and comprising at least one of a seat bottom and a seat back; and a first resilient support disposed between the frame and the seat structure so as to allow relative motion there between, the first resilient support comprising a first housing attached to one of the seat structure and the frame, the housing having a wall with an elongated slot extending there through, a first bracket arrangement attached to the other of the seat structure and the frame and extending through and slidable along the elongated slot, a first spring within the first housing and biasing the first bracket arrangement with respect to the first housing, and a first adjuster which varies a force that the first spring exerts between the first bracket arrangement and the first housing to thereby vary resiliency of the first resilient support.

2. The seat assembly as recited in claim 1 wherein the first bracket arrangement comprises a first bracket attached to the other of the seat structure and the frame, and a second bracket adjustably attached to the first bracket and coupled to the first spring by the first adjuster.

3. The seat assembly as recited in claim 1 further comprising a coupling pivotally connecting the seat structure to the frame.

4. The seat assembly as recited in claim 1 wherein the first adjuster comprises a member having threads which engage the first bracket arrangement and having a section which engages the first spring, wherein varying engagement of the threads with the first bracket arrangement alters a preload force of the first spring.

5. The seat assembly as recited in claim 1 further comprising a second resilient support disposed between the frame and the seat structure so as to allow relative motion there between, the second resilient support comprising a second housing attached to one of the seat structure and the frame, a second bracket arrangement attached to the other of the seat structure and the frame, a second spring biasing the second bracket arrangement with respect to the second housing, and a second adjuster which varies a force that the second spring exerts between the second bracket arrangement and the second housing to thereby vary resiliency of the second resilient support.

6. The seat assembly as recited in claim 5 wherein the first resilient support and the second resilient support are located on opposite sides of the seat structure.

7. A seat assembly for a wheelchair that has a frame, the seat assembly comprising:

a seat structure pivotally connected to the frame and capable of motion about a substantially horizontal axis relative to the frame; and a support disposed between the frame and the seat structure so as to allow relative pivotal motion there between, the support comprising:

(a) a housing attached to one of the seat structure and the frame and having a pair of longitudinal slots extending through opposite sides of the housing, (b) a bracket arrangement attached to the other of the seat structure and the frame and extending into the housing through the pair of longitudinal slots, and (c) a spring located in the housing and biasing the bracket arrangement with respect to the housing, and (d) an adjuster which varies a force that the spring exerts between the bracket arrangement and the housing to thereby vary resiliency of the support.

8. The seat assembly as recited in claim 7 wherein the bracket arrangement comprises a first bracket attached to the other of the seat structure and the frame, and a second bracket adjustably attached to the first bracket and extending into the housing and engaging the spring.

9. The seat assembly as recited in claim 7 wherein the adjuster engages an end of the spring and one of the housing and the bracket arrangement.

10. The seat assembly as recited in claim 7 wherein the adjuster comprises a member having a threaded shaft that extends into a threaded aperture in one of the housing and the bracket arrangement, wherein screwing the threaded shaft into and out of the threaded aperture varies the force exerted by the spring.

11. The seat assembly as recited in claim 7 wherein the bracket arrangement has a threaded aperture; and the adjuster comprises a threaded portion within the threaded aperture and an member which engages the spring, wherein moving the threaded portion within the threaded aperture alters a preload force of the spring.

12. A wheelchair comprising:

a frame;

a plurality of wheels rotationally connected to the frame;

a seat structure pivotally connected to the frame; and a resilient support disposed between the frame and the seat structure so as to allow relative pivotal motion there between, the resilient support comprising a housing attached to one of the seat structure and the frame and having a wall with an elongated slot extending there through, a bracket arrangement attached to the other of the seat structure and the frame and extending through and slidable along the elongated slot, a spring within the first housing and biasing the bracket arrangement with respect to the housing, and an adjuster which varies a force that the spring exerts between the bracket arrangement and the housing to thereby vary resiliency of the resilient support.

13. The wheelchair as recited in claim 12 wherein the bracket arrangement comprises a first bracket attached to the other of the seat structure and the frame, and a second bracket adjustably attached to the first bracket and engaging the spring.

14. The wheelchair as recited in claim 12 wherein the housing has a pair of longitudinal apertures on opposite sides and the bracket arrangement extends through the pair of longitudinal apertures and engages an end of the spring.

15. The wheelchair as recited in claim 12 wherein the adjuster comprises a member having a threaded shaft that extends into a threaded aperture in one of the housing and the bracket arrangement, wherein screwing the threaded shaft into and out of the threaded aperture varies the force exerted by the spring.

16. The seat assembly as recited in claim 12 wherein the bracket arrangement has a threaded aperture; and the adjuster comprises a threaded portion within the threaded aperture and having a member which engages the spring, wherein moving the threaded portion within the threaded aperture alters a preload force of the spring.

* * * * *